US005150753A

United States Patent [19]

Gaidry et al.

[11] Patent Number: 5,150,753

[45] Date of Patent: * Sep. 29, 1992

[54] GRAVEL PACK SCREEN HAVING RETENTION MESH SUPPORT AND FLUID PERMEABLE PARTICULATE SOLIDS

[75] Inventors: John E. Gaidry, Lafayette; Larry J. Quebedeaux, Sunset, both of La.; Joseph F. Donovan, Spring; Jefferson P. Ashton, Conroe, both of Tex.

[73] Assignee: Baker Hughes Incorporated, Houston, Tex.

[ * ] Notice: The portion of the term of this patent subsequent to Apr. 17, 2007 has been disclaimed.

[21] Appl. No.: 799,841

[22] Filed: Nov. 26, 1991

Related U.S. Application Data

[63] Continuation of Ser. No. 521,448, May 10, 1990, which is a continuation of Ser. No. 504,535, Apr. 4, 1990, abandoned, which is a continuation of Ser. No. 400,864, Aug. 30, 1989, abandoned, which is a continuation of Ser. No. 253,967, Oct. 5, 1988, Pat. No. 4,917,183.

[51] Int. Cl.[5] ..... E21B 43/08

[52] U.S. Cl. ..... 166/278; 166/228

[58] Field of Search ..... 166/276, 278, 51, 228, 166/230

[56] References Cited

U.S. PATENT DOCUMENTS

| | | | |
|---|---|---|---|
| 1,473,644 | 11/1923 | Rodrigo, Sr. | 166/228 X |
| 1,604,386 | 10/1926 | Byerly | 166/228 |
| 1,992,718 | 2/1935 | Records | 166/228 |
| 2,796,939 | 6/1957 | Woodruff | 166/228 |
| 4,649,996 | 3/1987 | Kojicic et al. | 166/228 |
| 4,700,777 | 10/1987 | Luers | 166/51 X |

*Primary Examiner*—William P. Neuder
*Attorney, Agent, or Firm*—Melvin A. Hunn

[57] ABSTRACT

An apparatus is provided for use on a subterranean well conduit. The apparatus comprises a cylindrically shaped inner tubular member having an interior and exterior walls. A fluid flow passageway is provided within the interior wall and a fluid flow passage extends from the interior of the tubular member through the exterior wall and in communication with the fluid flow passageway. Retention mesh means are disposed around the exterior of the tubular member and pass across the fluid flow passage means having a fluid flow openings therethrough, the retention mesh means preventing particulate solids in a fluid permeable bed of the apparatus from passing into the fluid flow passage and into the fluid flow passageway through the subterranean conduit. The fluid permeable bed of particulate solids, such as sand, bauxite, glass beads, or the like, is placed around the exterior of the retention mesh and is sized to prevent effectively all particulate matter in the well from passing inwardly through the fluid permeable bed and through the fluid flow passage means and into the fluid flow passageway when the conduit and the apparatus are positioned within the well. A fluid permeable housing is positioned around and exterior of said fluid permeable bed has fluid passages therethrough which are sized to permit well production fluids to pass interiorly through the housing but to prevent effectively all of the particulate solids of the fluid permeable bed from passing exteriorly through the housing and into the well.

17 Claims, 2 Drawing Sheets

GRAVEL PACK SCREEN HAVING RETENTION MESH SUPPORT AND FLUID PERMEABLE PARTICULATE SOLIDS

This application is a continuation of Ser. No. 521,448 filed May 10, 1990, now abandoned, which is a continuation of Ser. No. 504,535 filed Apr. 4, 1990, now abandoned, which is a continuation of Ser. No. 400,864 filed Aug. 30, 1989, now abandoned, which is a continuation of Ser. No. 253,967 filed Oct. 5, 1988, now U.S. Pat. No. 4,917,183.

BACKGROUND OF THE INVENTION

1. Field of the Invention

The present invention is directed to a screen device for use in a subterranean well and securable on a conduit as a "pre-packed" gravel packing screen. The screen may be used alone to filter particulate matter entering in the conduit with the produced hydrocarbons, or in combination with known gravel packing procedures in the well, to further filter such fluids.

2. Brief Description of the Prior Art

When oil and gas wells are drilled through formations which generally are of an unconsolidated nature, the produced fluids can be expected to contain said particulate matter, generally referred to as "sand". It is undesirable to produce such particulate matter with the production fluids because of abrasion of production tubing, valves and other equipment used to produce the well and carry such fluids from the well, through the sales line, and the like. It is therefore necessary in such instances to avoid production of such sand and other particulate matter with the fluids.

In the past, those skilled in the art have reduced the production of sand by "gravel packing" the well during completion operations. Such gravel packing includes providing on the production conduit or tubular work string a device including a slotted or ported cylindrically shaped member which prevents the passage therethrough and into the interior of the conduit of solid particles exceeding a predeterminable size. Such devices are incorporated into equipment and methods wherein gravel packing is introduced into the annular area between the production conduit or workstring and the casing of the well, or, in the event of non-cased wells, the well bore wall, with the gravel being deposited longitudinally exteriorly of the slotted or ported cylindrical member.

Gravel packing of such wells has also been effected by means of incorporation onto the production or workstring of a "pre-pack" apparatus, wherein gravel, glass beads, bauxite, or other solid particulate is disposed in between an outer member, such as stainless steel wire wrap screen, and an inner ported member, such that the device may be carried into the well and positioned adjacent the production zone to thereby prevent the particulate matter sand produced with the production fluids form entering the interior of the conduit and being produced to the top of the well with the production fluids. Such "pre-packs" may be used alone or in conjunction with apparatus and method wherein the well bore is also gravel packed.

The present invention provides a "pre-packed" apparatus and method for gravel packing a subterranean oil or gas well wherein a retention mesh having selectively sized openings between the mesh members is provided in the apparatus to prevent a fluid permeable bed of particulate solids around the exterior of the retention mesh and which is sized to prevent effectively all such particulate solids from passing inwardly through the retention mesh and through the interior of the device and thence through the conduit to the top of the well.

The prior art contains a number of references to gravel packing methods and apparatuses incorporating slotted, ported or wire-wrapped screen devices which have disposed therein particulate matter, such as glass beads, gravel and the like, including the following U.S. patents:

| Patent No. | Title |
|---|---|
| 1,218,848 | STRAINER FOR PUMPS |
| 2,190,989 | METHOD OF PREPARING AN OIL WELL FOR PRODUCTION |
| 2,371,385 | GRAVEL PACKED LINER AND PERFORATION ASSEMBLY |
| 2,523,091 | OIL-WATER SEPARATOR FOR WELLS |
| 2,525,897 | WELL PIPE FILTER |
| 2,530,223 | OIL WELL FILTER |
| 2,877,852 | WELL FILTERS |
| 2,978,033 | DRILLABLE PREPACKED SAND CONTROL LINER |
| 2,981,332 | WELL SCREENING METHOD AND DEVICE THEREFOR |
| 3,261,401 | WATER PRODUCTION |
| 3,455,387 | WELL COMPLETION TECHNIQUE AND APPARATUS FOR USE THEREWITH |
| 4,494,603 | WIRE MESH WELL SCREEN WITH WELDED WIRE SUPPORT |
| 4,583,594 | DOUBLE WALLED SCREEN-FILTER WITH PERFORATED JOINTS |
| 4,526,230 | DOUBLE WALLED SCREEN-FILTER WITH PERFORATED JOINTS |
| 4,649,996 | DOUBLE WALLED SCREEN-FILTER WITH PERFORATED JOINTS |

In the present invention, it has been found that a retention mesh means may be utilized to prevent the entry into the interior of the device of sized members of a particulate filtering bed, such as sand, bauxite, resin coated sand, and the like. Such device permits the sized particulate matter bed to be the primary filtering medium to effectively filter particulate matters out of the produced hydrocarbons in the subterranean well, thus permitting such produced hydrocarbons to pass freely of said particulate matter into and through said apparatus and said conduit to the top of the well. A secondary filtering means is defined by the retention mesh means which, in turn, prevents effectively all of the particles in the fluid permeable bed from passing through the retention mesh means to the interior of the apparatus and through the conduit to the top of the subterranean well with the produced hydrocarbon fluids.

In co-pending U.S. patent application Ser. No. 206,209, filed Jun. 13, 1988, entitled "Gravel Packer Apparatus", and assigned to the same assignee as the present application, the disclosure of which is hereby incorporated by reference, there is disclosed as a portion of said application a gravel packing screen device incorporation a wire mesh screen. In such application, the wire mesh screen serves as the primary filtering medium through which the produced hydrocarbons in the well may pass freely through the wire mesh screen and into the interior of the apparatus through the conduit to the top of the well substantially free of solids produced in said well. The present invention differs from said invention in that the retention mesh means of the present invention dies not act as the primary filtering medium for the well fluids, but, in effect, retains the particulate matter of the primary filtering medium, which is the fluid permeable bed of particulate solids, within the apparatus and prevents them from entering into the interior of the apparatus with the produced hydrocarbons.

SUMMARY OF THE INVENTION

The present invention provides an apparatus for use on a subterranean well conduit. The apparatus comprises a cylindrically shaped inner tubular member having an interior wall and an exterior wall. A fluid flow passageway is defined within the interior wall of the tubular member and a fluid flow passage means extends from the interior of the tubular member through the exterior wall of the tubular member and in communication with said fluid flow passageway. Retention mesh means are disposed around the exterior wall of said tubular member and passed across said fluid flow passage means, and have fluid flow openings therethrough. The retention mesh means prevents the particulate solids within a bed in the apparatus, said solids having a pre-determinable size, from passing into the fluid flow passage means and into the fluid flow passageway through the subterranean conduit. A fluid permeable bed of particulate solids is placed around the exterior of the retention mesh means and is sized to prevent effectively all such particulate matter in the well form passing inwardly through said retention mesh means and through said fluid flow passage means and into said fluid flow passageway when said conduit and said apparatus are positioned within the subterranean well. A cylindrically shaped outer fluid permeably housing is positioned around and exterior of the fluid permeable bed and has fluid passages therethrough sized to permit fluid to pass interiorly through said housing, but to prevent effectively all the particulate solids form passing exteriorly through said housing and into said well. At least one of the inner tubular members and the fluid permeably housing are securable at at least one of the ends to the subterranean conduit. The fluid permeably bed may be sand, bauxite, glass beads, or a resin coated sand. The fluid permeable housing may be a wire wrapped screen, or a slotted member.

DESCRIPTION OF THE PREFERRED EMBODIMENTS

Figure 1:
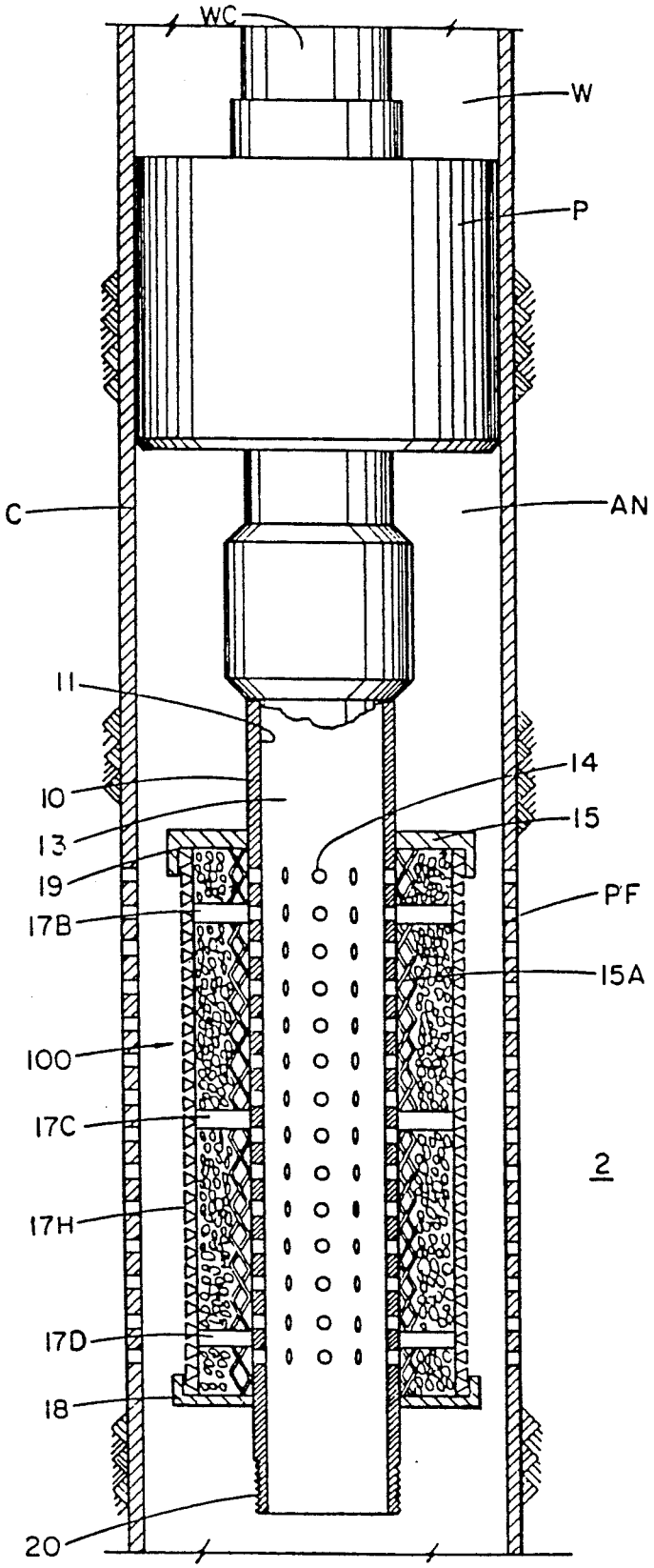
FIG. 1 is a longitudinally extending schematic sectional illustration of the apparatus of the present invention carried in a well interior of a casing and on a subterranean well conduit.

Now with reference to FIG. 1, there is shown in a longitudinally sectioned schematic illustration, a well W having cementitiously implaced therein a string of casing C and a packer P and apparatus 100 positioned therebelow, the packer P and apparatus 100 being carried into the well W and within the casing C on a well conduit WC, which may be a production or work string. While the apparatus 100 is shown below a packer P on the well conduit WC, it will be well appreciated by the those skilled in the art that the apparatus 100 may be used and carried within the well W in conjunction with a host of varying subterranean well tools, such as gravel packing apparatuses, including crossover tools, and the like, well perforating equipment, and other completion devices.

As shown in FIG. 1, there is provided within the well W an annulus AN interior of the casing C and exterior of the apparatus 100. When run into the well W, the apparatus 100 is placed adjacent a production zone Z which communicates with the annulus AN of the well W by means of perforations PF previously shot within the casing C prior to the entry of the well conduit WC into the well W. The perforations PF permit fluid hydrocarbons to pass interior of the casing C, into the annulus AN, thence within and through the apparatus 100 and the well conduit WC to the top of the well.

Figure 2:
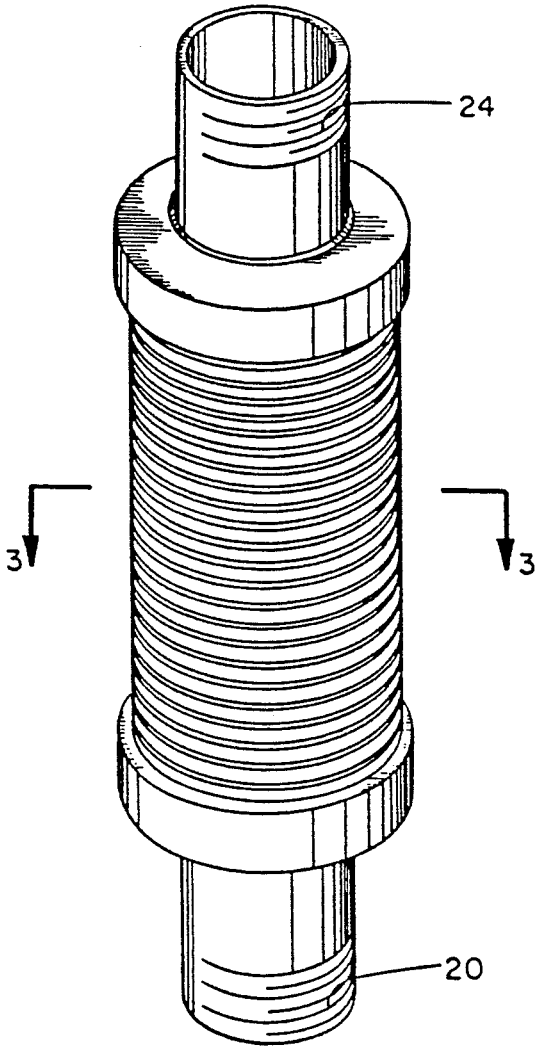
FIG. 2 is a longitudinal exterior view of the apparatus.
Figure 3:
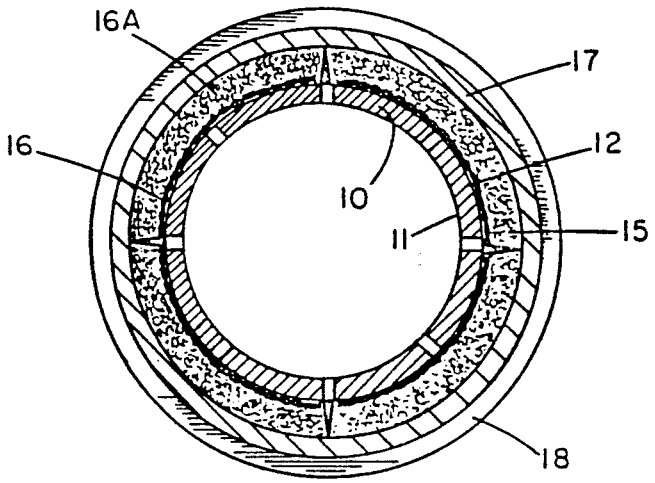
FIG. 3 is a cross-sectional view of the apparatus taken along the lines 3—3 of FIG. 2.

With reference now to FIGS. 1, 2 and 3, the apparatus 100 has an upper tubular member 10 having an interior wall 11 which provides a fluid flow passageway 13 in communication with the interior of the well conduit WC for transmission of fluids to the top of the well. The upper tubular member 10 has an exterior wall 12 (FIG. 3) for engagement therearound of a retention mesh means 15. The inner tubular member 10 also has a series of circumferentially positioned, longitudinally extending fluid flow passage means 14, which may be simply circular ports therethrough, for transmission of the fluid from the exterior of the inner tubular member 10 to the interior fluid flow passageway 13.

The retention mesh means 15 may be made of a variety of materials, such as a thermoplastic, stainless steel, yarns or the like, but which can effectively withstand the physical environment of the intended well application. For example, the retention mesh means 15 may have an inner wrapping and an outer wrapping, with the wrappings being interwoven for additional strength purposes. The retention mesh means 15 may be provided in any desired mesh openings between the wire members, but preferably will be a mesh size of about 6 and about 250. The retention mesh means 15 may be any one of a number of embodiments. The retention mesh means 15 may be made of plain steel wire or of an alloy or non-ferrous wire, such as steel, stainless steel, copper, 70/30 high brass, 90/10 commercial bronze, phosphor, monel, nickel, 50/56 aluminum, or combinations thereof. The retention mesh means 15 may also be made of any one of a number of special alloys including pure iron, high brass, phosphor bronze, pure nickel, and the like. It may be provided in a coated or uncoated form. In some instances it may be desirable to coat the retention mesh wires with chemical compounds, such as corrosion inhibitors or other chemical protective combinations.

The retention mesh means 15 may be provided in the form of any one of a number of weaves or crimps. Such weaves include a plain weave, a twilled weave, a plain dutch weave, or a twilled dutch weave. The wire mesh may also be provided in the form of a crimped weave, such as a double crimp, intermediate crimp, lock crimp, or smoothed top crimp. The retention mesh means 15 is secured, such as by chemical bonding, spot welding, or the like, around the exterior of the inner tubular member 10, such that the retention mesh means is placed across each of the fluid flow passage means 14. Alternatively, the retention mesh means 15 may be provided in the form of inter locking loop members, such as that illustrated in FIG. 3A of U.S. Pat. No. Re. 31,978 entitled "Well Tool Having Knitted Wire Mesh Seal Means and Method of Use Thereof", and assigned to Baker Oil Tools, Inc.

The retention mesh means 15 will have mesh openings 15A which are fluid flow openings to permit fluid which has been filtered through the fluid permeable bed 16 positioned exteriorly therearound to pass inwardly through the openings 15A and into the fluid flow passageway 13, thence to the top of the well through the well conduit WC. These mesh openings 15A are sized to permit the filtered fluid to pass interiorly and into the fluid flow passageway 13, but are so sized to prevent the particles incorporated within the fluid permeable bed 16 from passing inwardly therethrough and into the fluid flow passageway 13.

In a preferred embodiment, and as shown in FIG. 1, a series of circumferentially extending (and/or longitudinally extending) ribs, 17*b*, 17*c* and 17*d* may extend exteriorly from the inner tubular member 10 to the fluid permeable housing 17 to afford the apparatus 100 additional strength.

Exteriorly implaced around the retention mesh means 15 is a fluid permeable bed 16 of particulate solids which are sized to prevent effectively all the particulate matter in the well production fluids from passing inwardly through the bed 16 and the retention mesh means 15, and through the fluid flow passageway 13 when the well conduit WC and the apparatus 100 are positioned within the well W.

The particulate solid 16A forming the fluid permeable bed 16 may be silica sand, bauxite, such as sintered bauxite, or the like, or glass beads, or other solid, particulate matter known to those skilled in the gravel packing art. In a preferred form, sand is the particulate solid 16A and is coated with a one step phenolic resin cured prior to introduction of the apparatus into the well. Alternatively, the curing can be effected in situ in the subterranean well bore as the apparatus 100 is positioned within the well W on the well conduit WC. The resin, process of coating the particulate matter with the resin, bonding materials, and procedure for coating the sand with such resin may be that as shown and disclosed in U.S. Pat. No. 3,929,191, issued Dec. 30, 1975, entitled "Method for Treating Subterranean and Formation", the disclosure of which is hereby incorporated by reference.

The sizing of the particulate solid 16A must be made taking into the consideration the anticipated size of the particulate matter to be produced in the well with the production fluids. It is equally important that the retention mesh means 15 and mesh openings 15A thereof take into consideration the composition of the fluid permeable bed 16 and the sizing of the particulate solids 16A, such that the fluid permeable bed 16 and the sizing of the solids 16A prevent effectively the particulate matter in the well production fluids from passing through the bed 16 and the mesh openings 15A of the retention mesh means 15 and into the fluid flow passageway 13 through the fluid flow passage means 14. Typically, such particulate solids 16A will have a mesh size between about 6 and about 250 based upon the U.S. Standard Sieve Series. Accordingly, the openings 15A of the retention mesh means 15 will have a mesh size somewhat lower than the size of the particulate solids 16A.

Finally, around the exterior of the fluid permeable bed 16 is placed a fluid permeable housing 17 having fluid passages 17A therethrough for initial entry of fluid hydrocarbons therethrough. The passages 17A in the housing prevent the particulate solids 16A in the bed 16 from passing outwardly through the housing 17 and into the annulus AN of the well W. The housing 17 may take the form of wire-wrapped screen, slotted pipe, or the like, it being necessary for the housing 17 to only have passages 17A therethrough which permit the entry of the fluid hydrocarbons and prevents passage exteriorly therethrough of the particulate solids 16A in the bed 16.

The apparatus 100 is provided with upper and lower cylindrical ends, 19 and 18, and threads 20 at the lowermost end, if the apparatus 100 is to be secured to additional tools therebelow carried on the well conduit WC. Threads 21 are provided at the uppermost end of the apparatus 100 for securement to the well conduit WC, or other tubing carrying the apparatus 100 in the well W.

In the manufacture of the apparatus 100, as shown in the drawings, base pipe providing the inner tubular member 10 is cut to length and threaded. Holes are bored in the base pipe to provide the fluid flow passage means 14. The internal diameter of the base pipe is then deburred and the base pipe is drifted. The outer housing 17 is gauged and cut to length. The retention mesh which is utilized cut to proper dimensions and is mounted to the inner tubular member 10 and secured thereto with a high temperature teflon glass cloth. The sealing ends are taped and the overlapping areas are clothed. The screen outer housing 17 is slit over the wire mesh and the base pipe and one end of the outer housing is welded to the base pipe. The assembly is then placed in the vertical position with the welded end at the bottom. A special vibrator coupling is attached to the base pipe and an air supply is connected to the vibrator to turn on air for vibratory action. Thereafter the selected particulate matter 16A of the bed 16 is poured into the space between the jacket outer housing and the wire mesh cloth until full and allowed to vibrate an additional time period while incrementally adding the sand into this annular area if required. A congealing fluid is sprayed onto the exposed sand at the upper end and the upper end is taped with a masking tape to seal in the exposed sand. Thereafter, the apparatus 100 is moved to the horizontal position, the masking tape removed, and the upper end of the jacket is welded to the base pipe.

If the particulate matter 16A of the bed 16 is desired to be coated and cured, the apparatus is loaded into a furnace and cured. The curing may be of the sand only, or of the resin onto the sand in a pre-curing operation as shown in the drawings of U.S. Pat. No. 3,979,191. Thereafter, the apparatus 100 is removed from the furnace, the interior diameter is cleaned out with air pressure, redrifted, the threads are lubricated, couplings, if any are installed, and completed for use in the well W.

OPERATION

Now referring to FIG. 1, the apparatus 100 is affixed onto a well conduit WC below a packer P, or the like, and introduced into the well W interior of the casing C for positioning adjacent a production zone Z and perforations PF. If a resin is coated onto the particulate matter 16 of the bed 16, it may be cured prior to introduction into the well or in-situ by the temperature of the well and time required to implace the apparatus 100 adjacent the production zone Z. After curing, the coated resin will cause the particulate matter 16A to "bridge", but such "bridge" will not prevent fluid flow through the particles 16A for transmission through the mesh openings 15A, thence through the fluid flow passage means 14 and into the fluid flow passageway 13 to the top of the well through the well conduit WC.

As provided, the retention mesh means 15 does not filter the production fluids from the production zone Z. Rather, the retention mesh means 15 acts as to retain the particulate matter 16A in the bed 16, with the particulate matter 16A being the primary filter for the fluids from the production zone Z. Thus, as disclosed, the outer housing 17 and retention mesh means 15 act as a means for retaining the particulate matter 16A of the bed 16 in place within the apparatus 100 to act as a primary filter for the fluids of the production zone Z. In this way, the apparatus 100 is uniquely provided as a gravel packing "pre-pack", which may be utilized alone, or in combination with conventional or other gravel packing operations in a subterranean well to effectively filter the produced hydrocarbon fluids within the production zone Z.

A test was performed on the apparatus of the present invention to determine satisfactory filtration properties in a simulated subterranean well environment. The apparatus that was tested had an overall length of 10 inches with 6 and 7/8 inch of wire mesh screen having openings therethrough of 0.008 inches. The apparatus contained 10–60 U.S. mesh silica sand which was coated with a one step phenolic resin and cured.

To simulate particulate matter contained within a hydrocarbon production of a subterranean well, silica sand which is commonly used for testing air filters was combined with sodium feldspar and sieved using a sonic sifter to obtain a sized distribution of particles less than 25 microns. A second sized distribution of these particles was prepared which was greater than 32 microns, but less than 38 microns, and sieved.

The apparatus was placed in a section of 4½ inch casing having an internal diameter of 4.0 inches. A one inch nominal inlet was welded to the side of the casing approximately midway between the top and the bottom. The inside of the casing was painted with epoxy to prevent rust and scale from forming between test periods. A gauge was attached to the one inch inlet, as was a chamber to hold the solid contaminants. A deionized water source was attached to the chamber.

The circulating rate and pressure for simulation of the production fluid environment was established by circulating deionized water through the apparatus interior of the test fixture. The initial circulation rate was 4,000 milliliters per minute at a pressure of 9 psig. Solids where then introduced to the inlet, and the circulating rates and pressures were recorded.

In the first test, four grams of the 25 micron contaminant containing the silica/sodium feldspar was added to the device to simulate a solids load of 0.1%. After 4,000 milliliters of deionized water was thereafter injected, the contaminant had been displaced into the test fixture. No variation in the circulation rate or pressure was not. An additional 8000 milliliters of deionized water was thereafter injected through the device with no change in rate or pressure. The effluent was thereafter filtered through a 0.2 micron polycarbonate absolute filter and the solids were dried and weighed. The dried weight was 3.82 grams. When the test fixture was dismantled, small traces of solids were noticed inside the casing.

A second test was run using 10 grams of the 25 micron contaminant with 5000 milliliters of deionized water. No increase in pressure or flow rate was noted at 4000 milliliters per minute at 9 psig.

A third test was used using 10 grams of the 25 micron contaminant, as above, with no change in rate or pressure.

7½ grams of 25 micron contaminant was mixed with 7.5 grams of the 32–38 micron contaminant and placed in the test fixtures chamber. Approximately 5800 milliliters of deionized water was injected to displace the solids when a pressure increase of 1 psig was noted. The circulation rate was measured as 3200 milliliters per minute.

The above tests clearly indicate that there is no effective increase in pressure or reduction in flow rate when the apparatus of the present invention is tested in a simulated subterranean well environment under the test conditions. While a 50/50 mixture of 25 micron and 32–38 micron contaminants initiated some plugging of the apparatus during the testing procedure, as above, such plugging would be expected, and is not indicative of any failure of the apparatus, since the apparatus has been particularly designed to withstand and offset normal plugging occurring in a subterranean well environment.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for use on a subterranean well conduit to prevent particulate matter in said well of a predeterminable size from passing into said conduit with the well production fluids, comprising:

an inner member having an interior wall and an exterior wall, said exterior wall having a selected exterior wall shape;

a fluid flow passageway defined within the interior wall of said inner member;

fluid flow passage means extending from the interior of said inner member through the exterior wall of said inner member and in communication with said fluid flow passageway;

a retention barrier disposed around and secured to the exterior wall of said inner member and passing across said fluid flow passage means, and having fluid flow openings therethrough, said retention barrier being at least in-part structurally dependent on said inner member and conforming in shape to said selected exterior wall shape of said inner member when secured thereto;

a fluid permeable bed of particulate solids around the exterior of said retention barrier sized to prevent effectively all such particulate matter in said well from passing inwardly with the production fluids through said fluid permeable bed and through said fluid flow passage means and into said fluid flow passageway when said conduit and said apparatus are positioned within said subterranean well;

whereby said retention barrier is sized to prevent the particulate solids of said fluid permeable bed from passing into said fluid flow passage means and further sized to permit any particulate matter in said well passing through said fluid permeable bed to pass through the retention mesh means and into said fluid flow passageway and through the subterranean well conduit;

a circumferentially shaped outer fluid permeable housing positioned around the exterior of said fluid permeable bed and having fluid passages therethrough for transmission of the production fluids within said well through and housing, said fluid passages in said outer housing being sized to prevent effectively all of said particulate solids of said fluid permeable bed from passing exteriorly through said housing and into said well; and means for securing said apparatus to said subterranean well conduit.

2. The apparatus of claim 1 wherein said retention barrier is provided in the form of a weave of inner and outer members thereof.

3. The apparatus of claim 1 wherein the retention barrier is provided in the form of a weaver including a series of spaced inner and outer looped metallic weave elements.

4. The apparatus of claim 1 wherein the fluid permeable bed comprises particles of sand.

5. The apparatus of claim 1 wherein in the fluid permeable bed comprises bauxite.

6. The apparatus of claim 1 wherein the fluid permeable bed comprises glass beads.

7. The apparatus of claim 1 wherein the fluid permeable bed comprises a resin-coated sand.

8. The apparatus of claim 1 wherein the fluid permeable bed comprises a resin coated sand the resin for which is a one-step phenolic resin.

9. The apparatus of claim 1 wherein the fluid permeable bed is a resin coated sand, the resin being cured to the exterior of the sand particles prior to placement of the apparatus into the well on the conduit.

10. The apparatus of claim 1 wherein the fluid permeable bed is a resin coated sand, the resin being cured to the exterior of the sand particles in-situ within said well.

11. The apparatus of claim 1 wherein the fluid permeable bed comprises a resin-coated sand, said sand being coated with a fusible, one-step, resole-type phenolic resin said resin being fused and cured to the infusible state onto the exterior of the sand particles.

12. The apparatus of claim 1 wherein the fluid permeable bed comprises silica sand having a mesh size between about 6 and about 250 based upon the U.S. Standard Sieve Series.

13. The apparatus of claim 1 wherein the fluid permeable housing comprises a wire-wrapped screen supported by a plurality of interiorly positioned longitudinally spaced ribs.

14. The apparatus of claim 1 wherein the fluid permeable housing comprises a slotted member.

15. A method of gravel packing a subterranean oil or gas well, to prevent particulate matter in said well of a pre-determinable size from passing into said conduit with the well production fluids, comprising the steps of:

(1) introducing into said well a subterranean well conduit having disposed thereon at least one well packer apparatus and at least one gravel packing apparatus, said gravel packing apparatus comprising:

an inner member having an interior wall and an exterior wall, said exterior wall having a selected exterior wall shape;

a fluid flow passageway defined within the interior wall of said inner member;

fluid flow passage means extending from the interior of said tubular member thorough the exterior wall of said inner member and in communication with said fluid flow passageway;

a retention barrier disposed around the exterior wall of said inner member and passing across said fluid flow passage means, and having fluid flow openings therethrough, said retention barrier being at least in-part structurally dependent on said inner member and conforming in shape to said selected exterior wall shape of said inner member when secured thereto;

a fluid permeable bed of particulate solids around the exterior of said retention barrier sized to prevent effectively all such particulate matter in said well from passing inwardly with the production fluids through said fluid permeable bed and through said fluid flow passage means and into said fluid flow passageway when said conduit and said apparatus are positioned within said subterranean well;

whereby said retention barrier is sized to prevent the particulate solids of said fluid permeable bed from passing into said fluid flow passage means and into said fluid flow passageway and is further sized to permit any particulate matter in said well passing through said fluid permeable bed to pass through the retention barrier and through the subterranean well conduit; and a circumferentially shaped outer fluid permeable housing positioned around the exterior of said fluid permeable bed and having fluid passages therethrough for transmission of the production fluids within said well through said housing, said fluid passages in said outer housing being sized to prevent effectively all of said particulate solids of said fluid permeable bed from passing exteriorly through said housing and into said well, at least one of said inner member and said fluid permeable housing being securable at at least one of its respective ends to the subterranean well conduit;

(2) placing said gravel packing apparatus adjacent a production zone in said well;

(3) setting said well packer; and (4) introducing a carrier fluid containing a particulate matter into said well conduit for placement of said particulate matter exterior of said well conduit and adjacent said production formation.

16. A method gravel packing a subterranean oil or gas well, comprising the steps of:

(1) introducing into the well a conduit having a gravel packing apparatus thereon, said gravel packing apparatus comprising:

a cylindrically shaped inner tubular member having an interior wall and an exterior wall;

a fluid flow passageway defined within the interior wall of said tubular member;

fluid flow passage means extending from the interior wall of said tubular member through the exterior wall of said tubular member and in communication with said fluid flow passageway;

a cylindrical shaped retention barrier disposed around the exterior wall of said tubular member and passing across said fluid flow passage means, and having fluid flow openings therethrough, said retention barrier being structurally dependent on said tubular member for its cylindrical shape, and being secured to said tubular member to maintain its cylindrical shape;

a fluid permeable bed of particulate solids around the exterior of said retention barrier sized to prevent effectively all such particulate matter in said well from passing inwardly with the production fluids through said fluid permeable bed and through said fluid flow passage means and into said fluid flow passageway when said conduit and said apparatus are positioned within said subterranean well;

whereby said retention barrier is sided to prevent the particulate solids of said fluid permeable bed from passing into said fluid flow passage means and into said fluid flow passageway and is further sized to permit any particulate matter in said well passing through said fluid permeable bed to pass through the retention barrier and through the subterranean well conduit; and a circumferentially shaped outer fluid permeable housing positioned around the exterior of said fluid permeable bed and having fluid passages therethrough for transmission of the production fluids within said well through said housing, said fluid passages in said outer housing being sized to prevent effectively all of said particulate solids of said fluid permeable bed from passing exteriorly through said housing and into said well, at least one of said inner tubular member and said fluid permeable housing being securable at at least one of its respective ends to the subterranean well conduit (1) positioning said conduit in said well such that said gravel packing apparatus is disposed in said well adjacent a hydrocarbon production zone in said well; and (3) flowing fluid through said well and into said gravel packing apparatus and said conduit to the top of the well such that fluid produced from said well and into said conduit does not contain particulate matter of a pre-determinable size.

17. An apparatus for use in a subterranean well conduit to prevent particulate matter in said well of a pre-determinable size from passing into said conduit with the well production fluids, comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

a cylindrical shaped retention barrier disposed around and secured to the exterior wall of said tubular member, and structurally dependent on said exterior wall of said tubular member which forms and maintains said cylindrical shape of said retention barrier, and passing across said fluid flow passage means, and having fluid flow openings therethrough;

a fluid permeable bed of particulate solids around the exterior of said retention barrier sized to prevent effectively all such particulate matter in said well form passing inwardly with the production fluids through said fluid permeable bed and through said fluid flow passage means and into said fluid flow passageway when said conduit and said apparatus are positioned within said subterranean well;

whereby said retention barrier is sized to prevent the particulate solids of said fluid permeable bed from passing into said fluid flow passage means and into said fluid flow passageway and is further sized to permit any particulate matter in said well passing through said fluid permeable bed to pass through the retention barrier and through the subterranean well conduit; and a circumferentially shaped outer fluid permeable housing positioned around the exterior of said fluid permeable bed and having fluid passages therethrough for transmission of the production fluids within said well through said housing, said fluid passages in said outer housing being sized to prevent effectively all of said particulate solids of said fluid permeable bed from passing exteriorly through said housing and into said well.

* * * * *

UNITED STATES PATENT AND TRADEMARK OFFICE

CERTIFICATE OF CORRECTION

PATENT NO. : 5,150,753

DATED : September 29, 1992

INVENTOR(S) : John E. Gaidry, Larry J. Quebedeaux, Joseph F. Donovan, & Jefferson P. Ashton

It is certified that error appears in the above-identified patent and that said Letters Patent is hereby corrected as shown below:

At column 2, line 59, delete "incorporation" and insert "incorporating";
at column 2, line 67, delete "dies" and insert "does";
at column 3, line 46, delete "form" and insert "from";
at column 5, line 34, insert "-" between "in" and "situ";
at column 6, line 49, delete "3,979,191," and insert "3,929,191";
at column 6, line 62, delete "16" between ""ter" and "of" and insert "16A";
at column 7, line 25, delete "10" and insert "40";
at column 7, line 28, insert "a" between "well," and "silica";
at column 7, line 56, delete "not" and insert "noted";
at column 9, line 7, delete "and" and insert "said";
at column 10, line 2,delete "thorough" and insert "through";
at column 11, line 32, insert ";" after "conduit";
at column 11, line 33, delete "(1)" and insert "(2)" in its place.

Signed and Sealed this

Thirtieth Day of November, 1993

*Attest:*

*Attesting Officer*

BRUCE LEHMAN

*Commissioner of Patents and Trademarks*